US009500027B2

(12) United States Patent
Walter et al.

(10) Patent No.: US 9,500,027 B2
(45) Date of Patent: Nov. 22, 2016

(54) PORTAL LADDER

(71) Applicant: Safariland, LLC, Jacksonville, FL (US)

(72) Inventors: Brian Walter, Pittsfield, MA (US); Brad Glass, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 14/471,780

(22) Filed: Aug. 28, 2014

(65) Prior Publication Data

US 2015/0060204 A1 Mar. 5, 2015

Related U.S. Application Data

(60) Provisional application No. 61/872,349, filed on Aug. 30, 2013.

(51) Int. Cl.

| | |
|---|---|
| ***E06C 1/383*** | (2006.01) |
| ***E06C 7/08*** | (2006.01) |
| ***E06C 7/10*** | (2006.01) |
| ***E06C 7/50*** | (2006.01) |
| ***E06C 1/52*** | (2006.01) |

(52) U.S. Cl.

CPC ..... *E06C 1/383* (2013.01); *E06C 1/52* (2013.01); *E06C 7/08* (2013.01); *E06C 7/10* (2013.01); *E06C 7/50* (2013.01)

(58) Field of Classification Search

CPC ..... E04C 3/005; A61G 1/013; E01D 15/124; E06C 1/38; E06C 1/383; E06C 1/3835; E06C 1/52; E06C 7/08; E06C 7/50; E06C 7/082; E06C 7/10; E06C 7/00

See application file for complete search history.

(56) References Cited

U.S. PATENT DOCUMENTS

| | | | | |
|---|---|---|---|---|
| 277,222 | A * | 5/1883 | Bush | E06C 1/56 182/196 |
| 2,806,562 | A * | 9/1957 | Harman | B66C 23/64 182/41 |
| 4,193,476 | A * | 3/1980 | Emmons | E06C 1/56 182/164 |
| 4,884,659 | A * | 12/1989 | Chao | E06C 5/30 182/164 |
| 5,944,141 | A * | 8/1999 | Kochan | E06C 1/52 182/159 |
| 6,079,072 | A * | 6/2000 | Katsiri | A61G 1/013 14/2.4 |
| 6,119,811 | A | 9/2000 | Tsung-Ping | |
| 6,318,498 | B1 * | 11/2001 | Warner | E06C 1/52 182/156 |
| 2006/0032705 | A1 * | 2/2006 | Isham | B29C 43/003 182/46 |
| 2007/0205053 | A1 * | 9/2007 | Isham | B29C 43/003 182/207 |

(Continued)

FOREIGN PATENT DOCUMENTS

| | | |
|---|---|---|
| DE | 473534 C | 3/1929 |
| GB | 567073 A | 1/1945 |

OTHER PUBLICATIONS

PCT International Appln. No. PCT/US2014/053188, International Search Report and Written Opinion dated Dec. 4, 2014.

*Primary Examiner* — Daniel Cahn

(74) *Attorney, Agent, or Firm* — Kane Kessler, P.C.; Paul E. Szabo

(57) ABSTRACT

A foldable ladder has multiple ladder segments that fold and unfold relative to each other. Each ladder segment includes one rung element and multiple side rail sections that unfold for deployment to form box-shaped side rails of the ladder. Adjacent ladder segments are connected to each other by hinge joints. The ladder includes locking features at the hinge joints for preventing relative pivoting movement of adjacent ladder segments by more than about 180 degrees.

1 Claim, 9 Drawing Sheets

(56) References Cited

U.S. PATENT DOCUMENTS

2011/0114419 A1* 5/2011 Merey ..... E06C 1/383
182/152

2014/0209412 A1* 7/2014 Zorney ..... E06C 7/08
182/180.1

* cited by examiner

PORTAL LADDER

RELATED APPLICATION

This application is a nonprovisional of U.S. provisional application No. 61/872,349, filed Aug. 30, 2013 by the same inventors. This application claims the benefit of that said provisional application and incorporates by reference its disclosure.

BACKGROUND OF THE INVENTION

The invention relates to a ladder. In particular, this invention relates to a portable ladder than can be folded for storage and transport, then deployed (unfolded) for use. Such ladders are sometimes used by military or police to scale obstacles encountered in the field.

One ladder of this general type is shown in U.S. Pat. No. 6,318,498 and includes a plurality of ladder segments that are hinged together. Two adjacent segments can freely pivot almost 360 degrees relative to each other, at the hinge joint. Each segment includes one rung and is typically one foot long. When the segments are unfolded and laid flat, the segments and rungs are arranged one after the other along the length of the ladder. The ladder has two side rails, one on each side of the rungs. Each side rail is generally C-shaped and includes three hingedly connected sections that are flat with the rungs when the ladder is folded; that are flat also when the ladder is first unfolded to be deployed; and that pivot or spring out into the C-shape when deployed to form the structural support (side rails) for the rung segments.

Specifically, in each ladder segment, a first or inner section of each side rail is fixed to the rung and extends perpendicular to the length of the rung, in the plane of the rung. A second or middle section of the side rail extends from the outer edge of the inner section, in a direction perpendicular to the inner section, and forms the outermost portion of the side rail. A third rail section or return extends inward from the outer edge of the middle section, in a direction parallel to the inner section. The three rail sections thus form a generally C-shaped box configuration. Springs, or a strap extending across between the two side rails, holds the side rail sections in the deployed condition. The side rails provide structural strength to hold the several ladder segments in position relative to each other without buckling or folding. This is needed because two adjacent ladder segments can freely pivot almost 360 degrees relative to each other, at the hinge joint.

The ladder is folded in an accordion style, with hinge joints between adjacent ladder segments. Specifically, one hinge joint allows for relative pivoting movement of its two connected segments in one direction, while the next hinge joint along the length of the ladder allows for relative pivotal movement of its two connected segments in the opposite direction. This allows the ladder to be folded, accordion style, into a small package that can be transported more easily. But because the hinge joints do not lock, they do not provide any structural strength to hold the ladder in the deployed (extended) condition.

It is sometimes desired to employ a foldable ladder of this type in a horizontal orientation, to enable the user to walk or crawl across it. Because the hinge joints of the prior art ladder do not provide any resistance to bending in either direction, the side rails may not be stiff enough to bear the load.

DESCRIPTION OF AN EMBODIMENT

Figure 1:
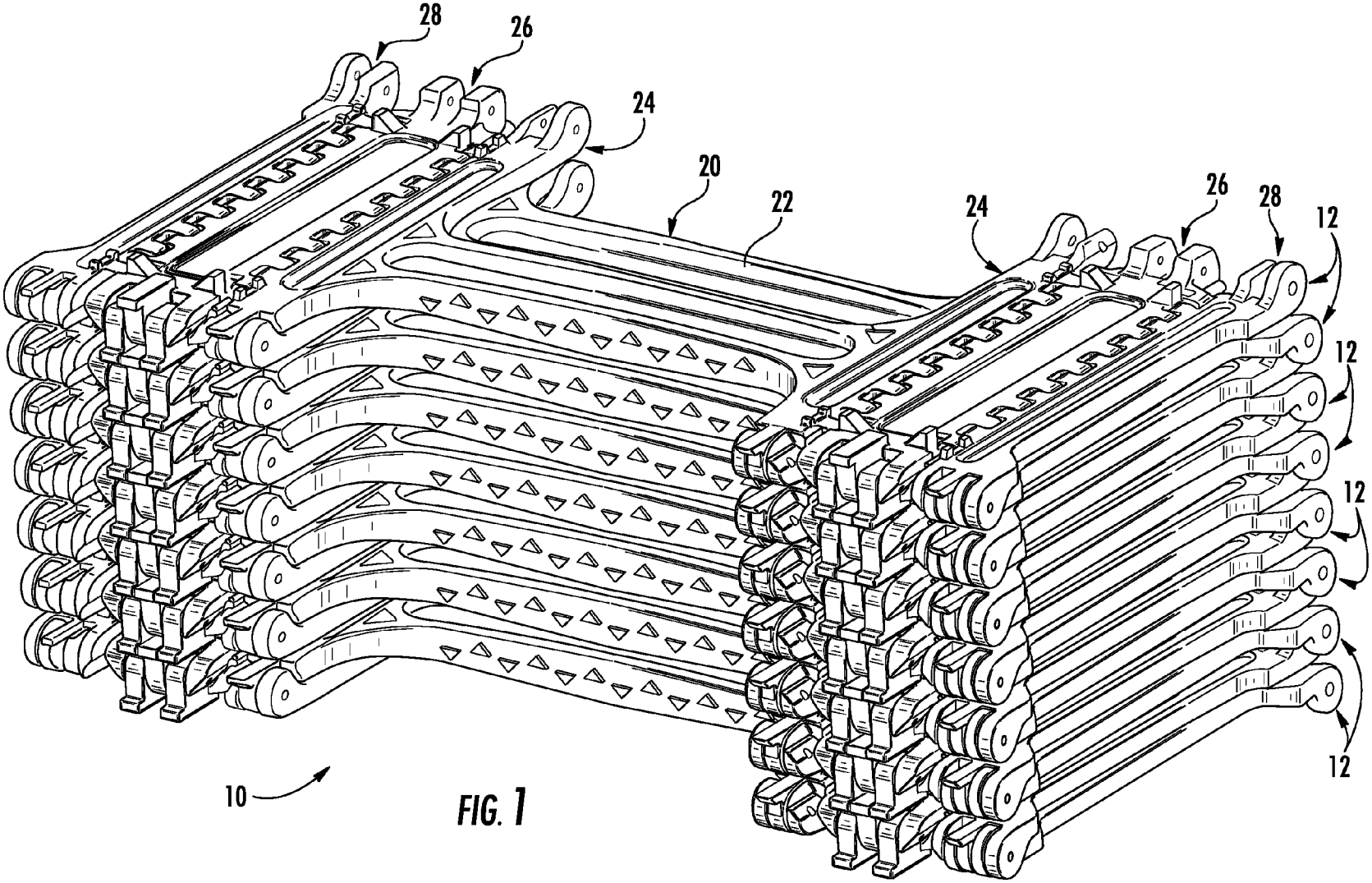
FIG. 1 is a perspective view of a ladder that is a first embodiment of the invention, shown in a folded condition.
Figure 2:
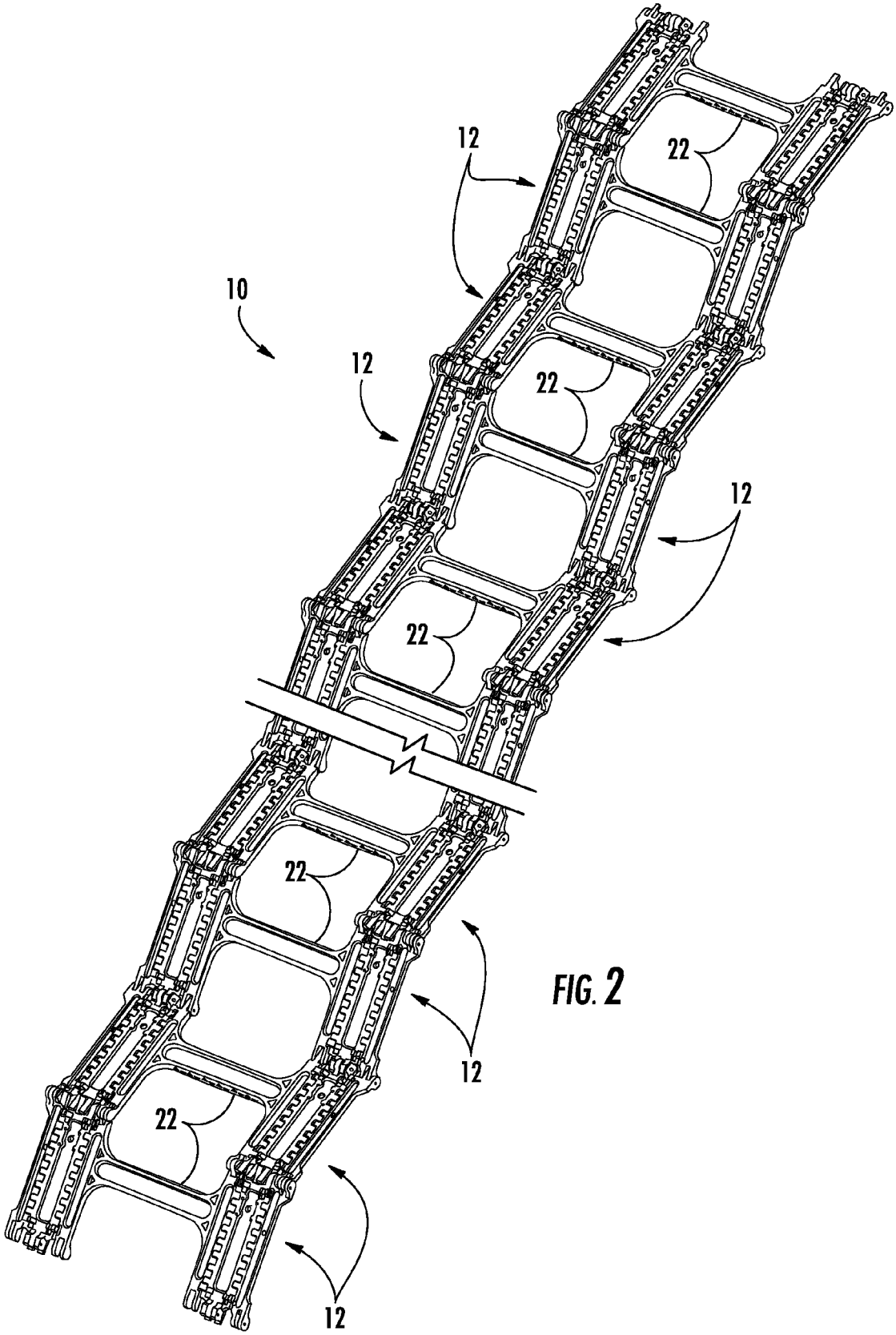
FIG. 2 is a perspective view of the ladder of FIG. 1 shown in a condition partially unfolded.
Figure 3:
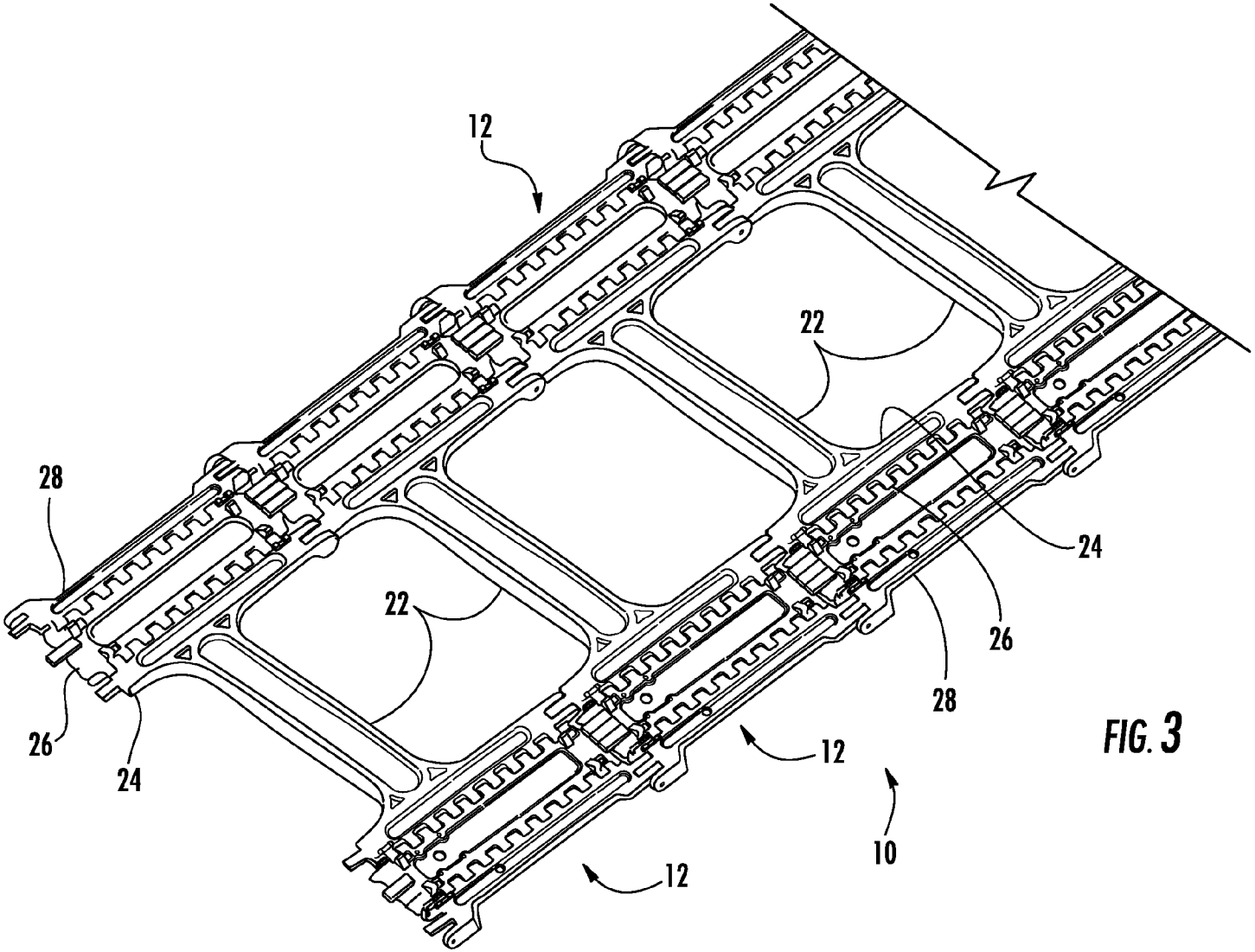
FIG. 3 is a perspective view of the ladder of FIG. 1 shown in an unfolded or extended condition.

This invention relates to a ladder. In particular, this invention relates to a portable ladder that can be folded for storage and transport, then deployed (unfolded) for use. The invention is applicable to portable ladders of varying, different constructions. As representative of the invention, the drawings illustrated a ladder 10 that is a first embodiment of the invention. The ladder is shown in FIG. 1 in a folded condition for storage or transportation, and in FIG. 2 in an almost completely unfolded (extended, deployed) condition. A portion of the ladder is shown in FIG. 3 in the extended condition, prior to formation of the side rails of the ladder.

The ladder 10 includes multiple ladder segments 12. Each ladder segment 12 includes five relatively movable pieces. The five pieces include, first, a rung element 20 that includes a rung 22 with inner rail sections 24 at each end. The five pieces also include two middle rail sections 26 that are hingedly connected to the inner rail sections 24. The five pieces also include two outer rail sections (returns) 28 that are hingedly connected to the middle rail sections 26. When the ladder 10 is deployed as described below, on each lateral side of the rungs 22 the inner rail sections 24, the middle rail sections 26, and the returns 28 together form side rails 30 of the ladder, in a manner generally similar to the prior art ladder described above.

Each inner side rail section 24 has an elongate configuration with a female portion 32 of a hinge joint at one end and a male portion 34 of the hinge joint at the other end. Alternating rung elements 20 have their inner rail sections 24 reversed in orientation along the length of the ladder 10, so that the female joint portion 32 on one rung element 20 of one ladder segment 12 engages with the male joint portion 34 on the next segment, etc. (The terms "female" and "male" are used herein for clarity and are not necessarily wholly descriptive.)

Figure 4:
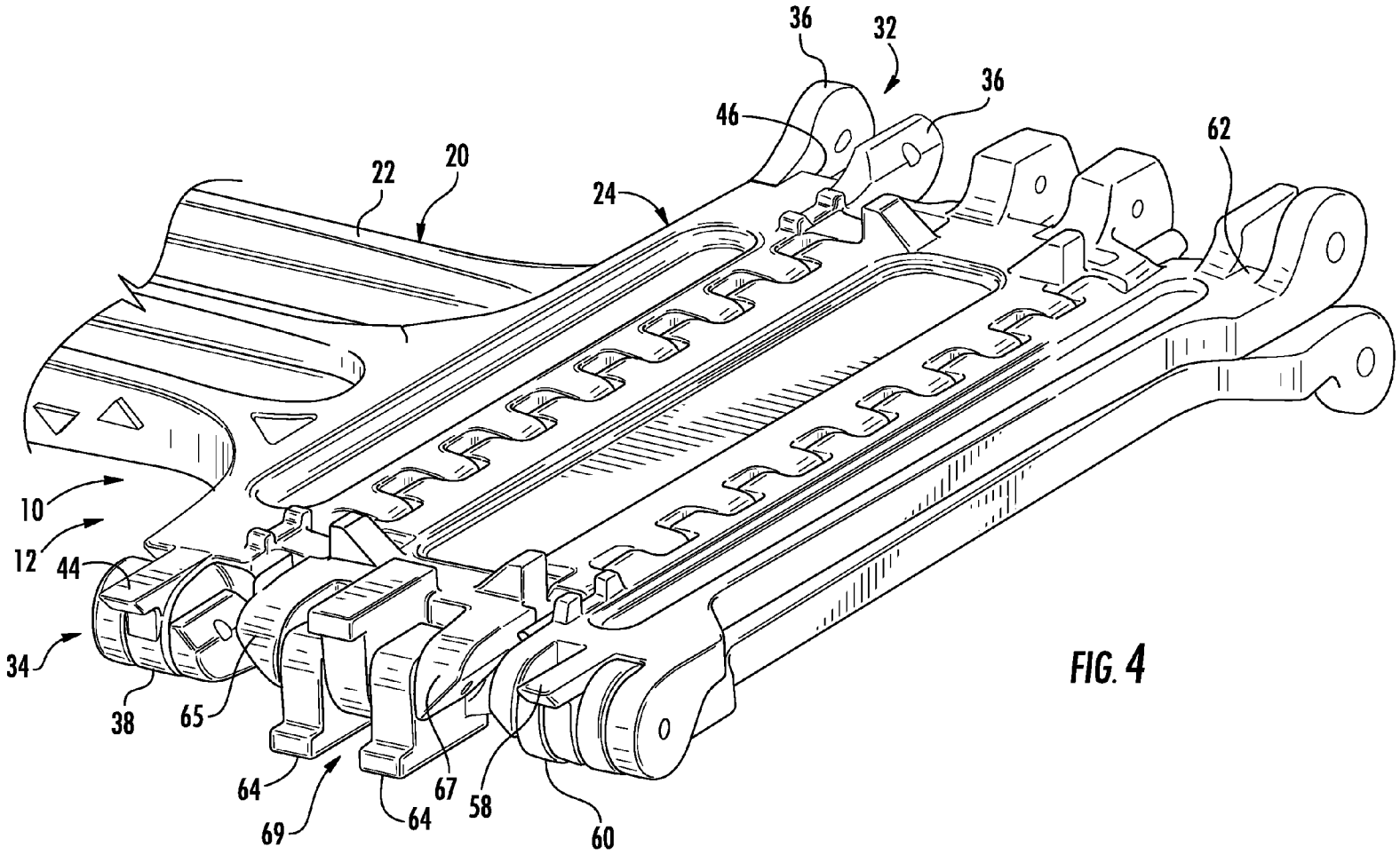
FIG. 4 is an enlarged perspective view of a portion of the unfolded ladder of FIG. 2.

The female joint portion 32 (FIG. 4) on the inner rail section 24 includes two knuckles 36. The male joint portion 34 on the opposite end of the inner rail section 24 includes a single knuckle 38. When the female joint portion 32 on one rung element 20 is engaged with the male joint portion 34 on an adjacent rung element 20, the single knuckle 38 on the male joint portion fits between the two knuckles 36 on the female joint portion. A hinge pin secures the connection. This engagement provides a pivotal connection between adjacent rung elements 20 and thus between adjacent ladder segments 12. Because the rung element 20 has inner rail sections 32 on either lateral side of the rung 22, there are two such pivotal connections between the adjacent ladder segments 12.

The ladder 10 of the present invention includes a number of stops at each hinge joint between adjacent ladder segments 12 that prevent any two adjacent ladder segments from being unfolded more than about 180°. This construction helps to increase the rigidity of the ladder 10, and to prevent pivotal (bending or buckling) movement between adjacent ladder segments 12, to a greater degree than is obtained simply by the side rails 30.

Figure 5:
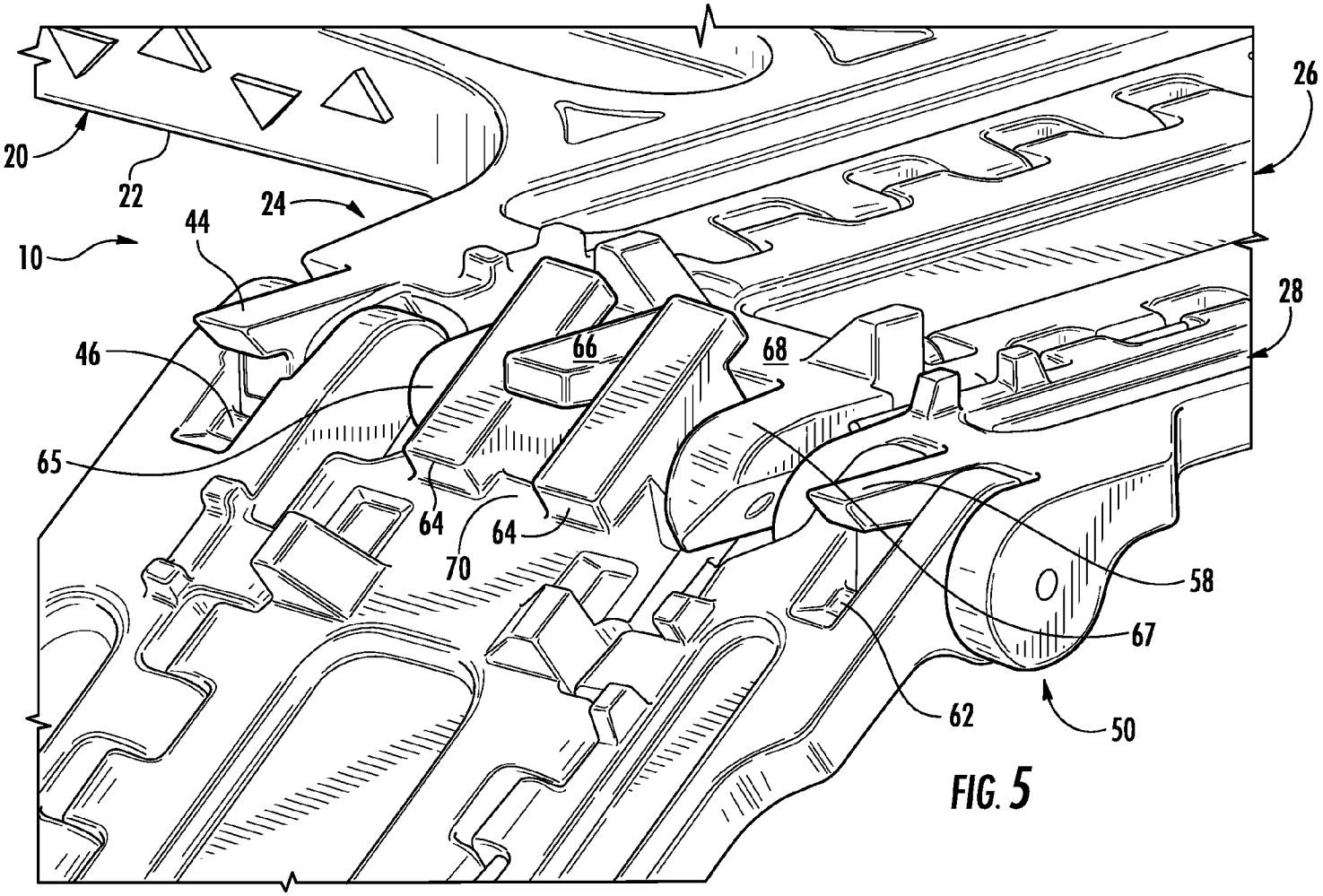
FIG. 5 is an enlarged perspective view of a hinge joint of the ladder of FIG. 1 shown in a partially folded condition.

The stops are provided at several different locations. A first set of stops (FIGS. 4 and 5) is provided on the inner sections 24 of the side rails 30. Specifically, a tab 44 on the single knuckle 38 of the male portion 34 of the hinge joint is engageable with a stop surface 46 (see also FIG. 5) on the female portion 32 of the hinge joint, located between the two knuckles 36, when the two ladder segments 12 are folded out to be co-planar. This engagement prevents adjacent rung elements 20 from folding out more than about 180 degrees relative to each other.

Because the ladder segments 12 are reversed in orientation, one after another along the length of the ladder 10, this stop construction results in alternating "up joints" 48 and "down joints" 50 along the length of the deployed ladder. That is, when the deployed ladder 10 is horizontal, every other joint will be able to buckle upward ("up joint" 48) and the others will be able to buckle downward ("down joint" 50). In the drawings, the down joints 50 are the joints that are illustrated with the knuckles 36 and 38 sticking up. The resistance to bending of the joints, as provided by this first set of stops 44 and 46, adds significantly to the structural strength that is provided by the side rails 30.

A second set of stops is provided on the returns 38, where adjacent returns are hinged together with a second hinge pin. The stops on the returns 28 are similar in configuration to the stops on the inner rail sections 24. Specifically, a tab 58 on the single knuckle 60 of the male portion of the hinge joint is engageable with a stop surface 62 on the female portion of the hinge joint, when the two ladder segments 12 are folded out to be co-planar. These stops 58, 62 on the returns 28 work in conjunction with the stops 44, 46 on the inner sections 24 to help prevent the ladder segments 12 from folding out more than about 180 degrees relative to each other.

The ladder includes a third set of stops that resist backward bending of the ladder segments 12 and add to load carrying strength. The third set of stops is found on the middle sections 26 of the side rails 30, where adjacent middle sections are hinged together with a third hinge pin.

The stops on the middle sections 26 are different in configuration from the stops on the inner sections 24 and the stops on the returns 28. Specifically, each side rail middle section 26 has, at one end, two locking fingers 64 that are spaced apart laterally from each other. Located laterally between them is a single locking finger 66 that is formed on the opposite end of the adjacent middle section 26. When the two ladder segments 12 (and thus the two middle rail sections 26) are pivoted to be coplanar, the ends of the two locking fingers 64 on the one section engage on and bear on stop surfaces 68 on the other section; simultaneously, the end of the single locking finger 66 on the other section engages on and bears on a stop surface 70 on the one section. This engagement helps to prevent the two middle sections 36 from bending more than about 180 degrees relative to each other, thus providing structural rigidity at the hinge joint.

Figure 6:
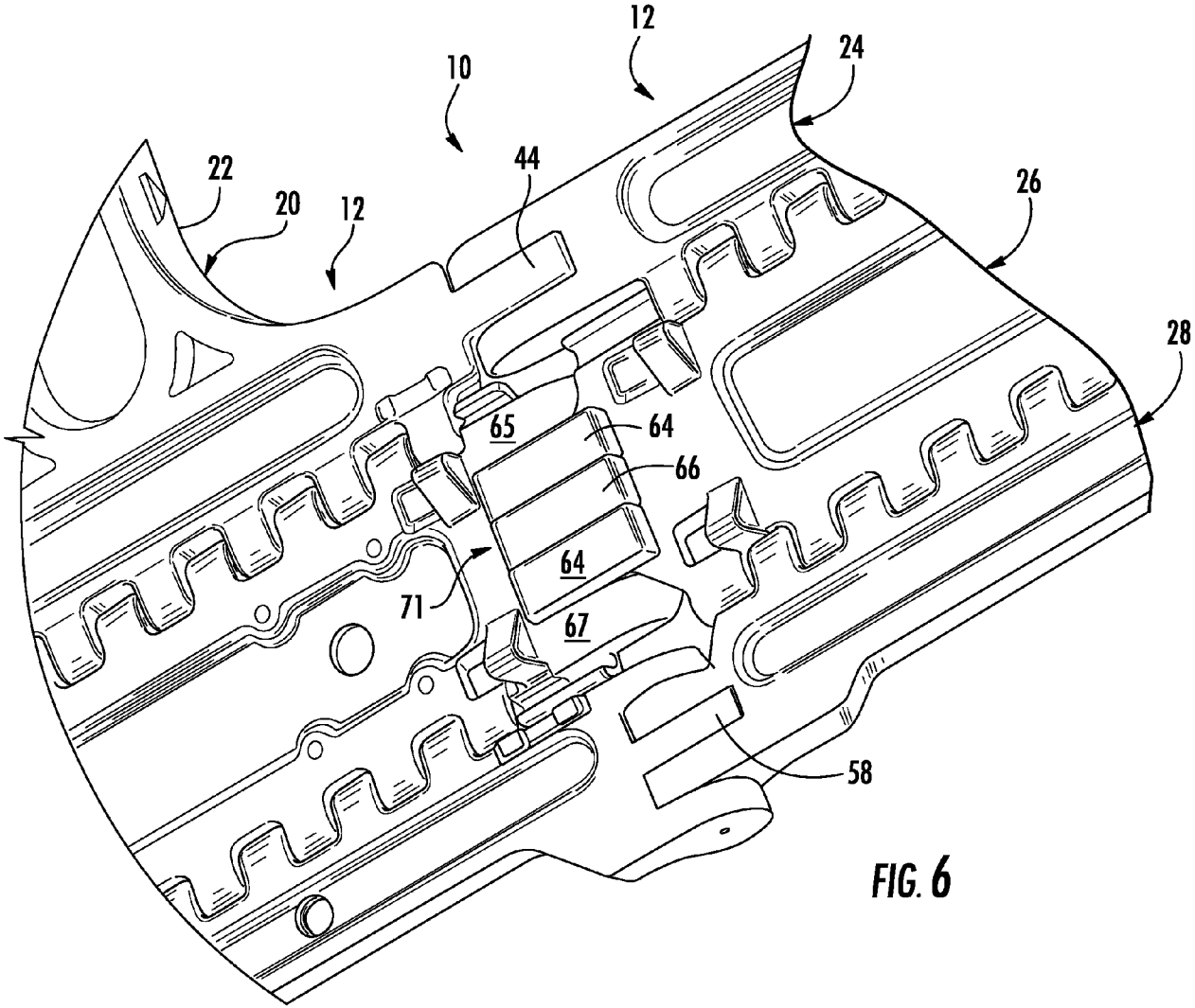
FIG. 6 is an enlarged perspective view of the hinge joint of FIG. 5 shown in an unfolded or extended condition.
Figure 7:
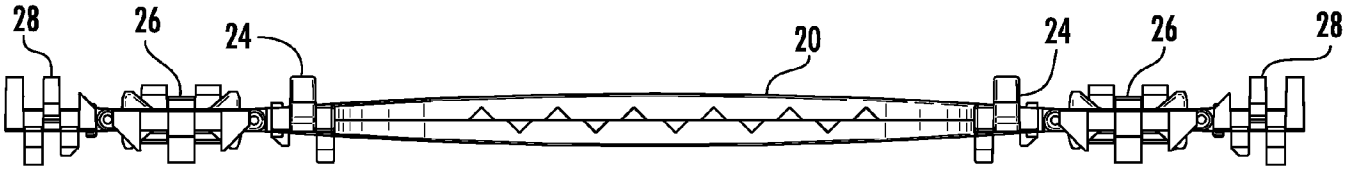
FIGS. 7-9 are a series of view showing the formation of the side rails of the ladder of FIG. 1.
Figure 8:
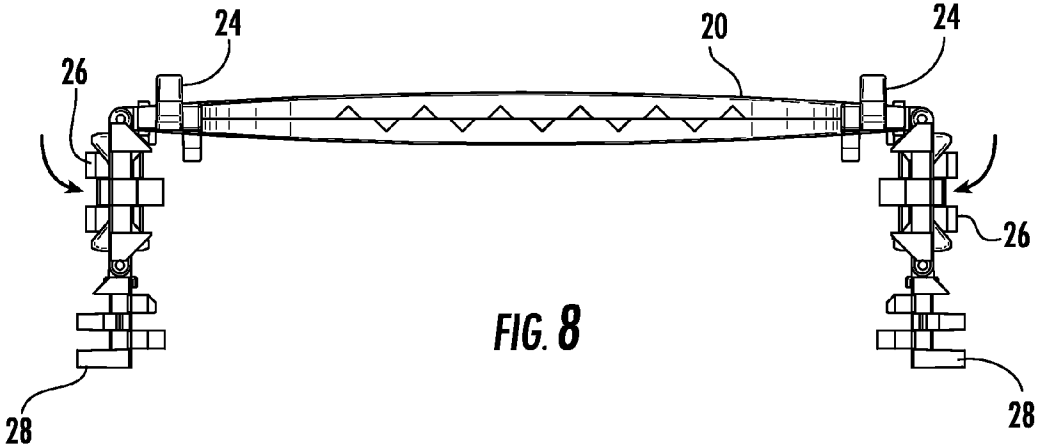
Figure 9:
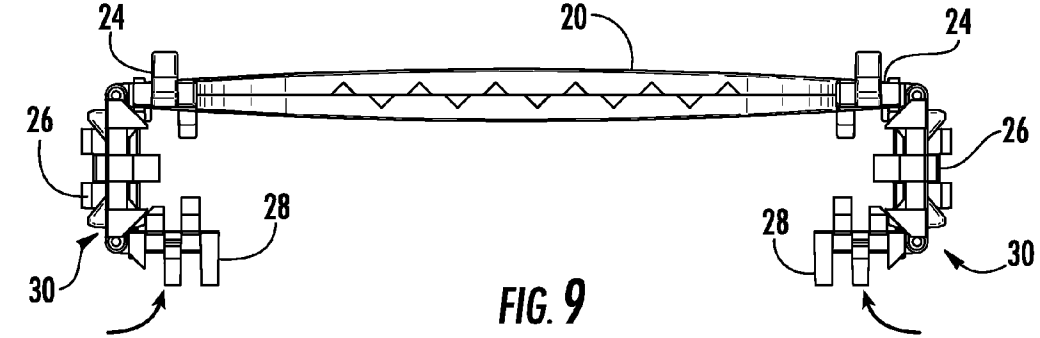
Figure 10:
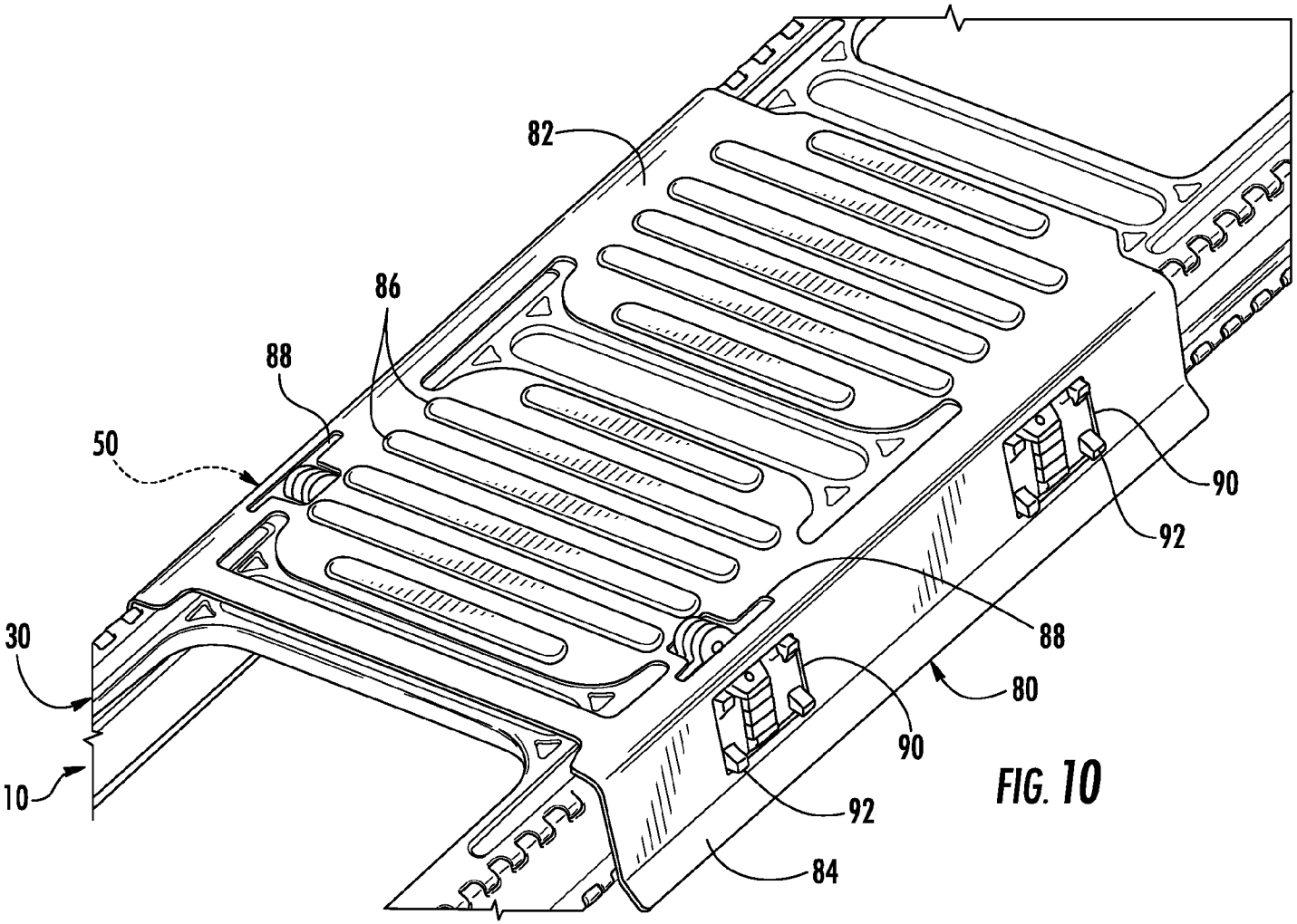
FIG. 10 is a view showing a bridge plate that can be used with the ladder of the present invention.
Figure 11:
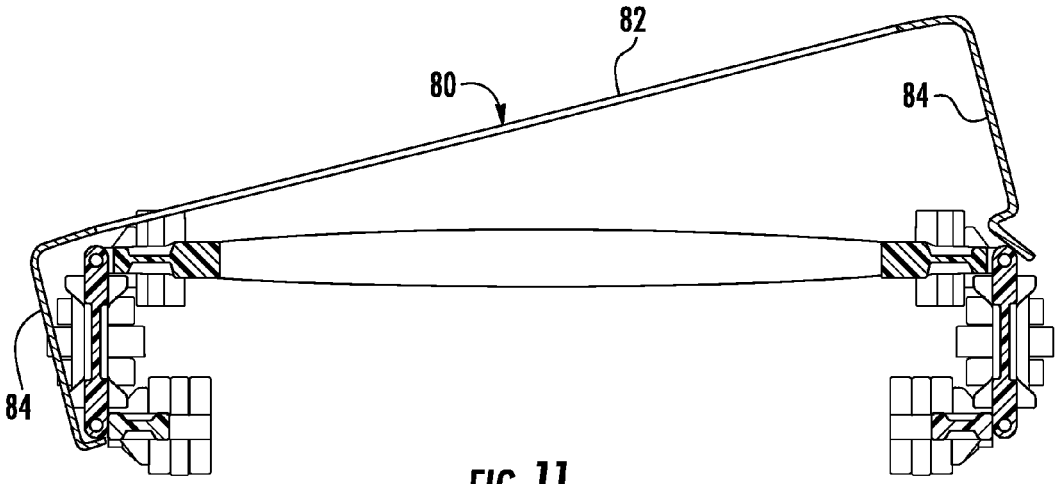
FIGS. 11-13 are a series of views illustrating the installation of the bridge plate of FIG. 10 on the ladder of FIG. 1.
Figure 12:
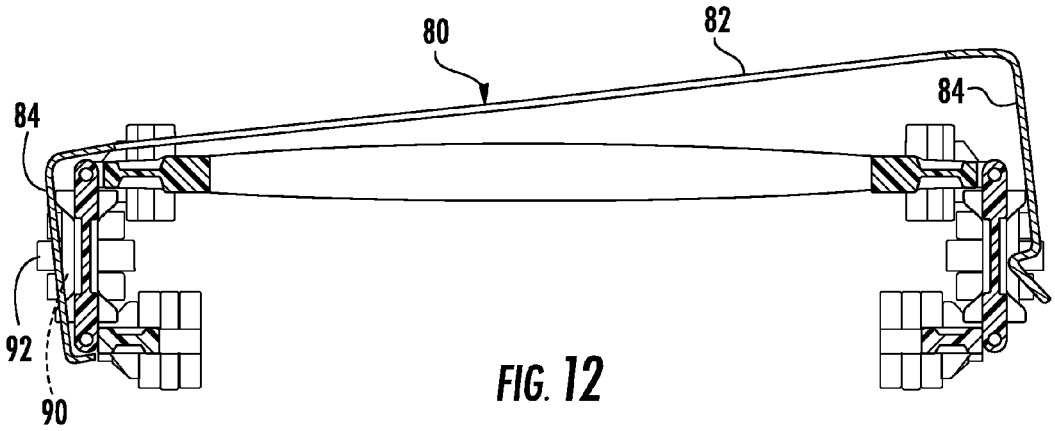
Figure 13:
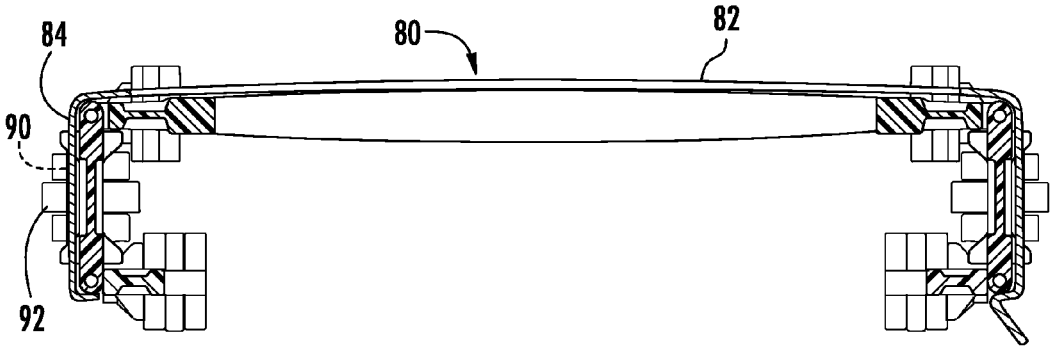

The stops on the side rail middle sections 26 have an additional benefit. When the ladder 10 is extended, the middle sections 26, which are part of the C-shaped side rails 30, extend perpendicular to the plane of the rungs 22. The three fingers 64 and 66 abut each other laterally and interlock across the hinge joint, as seen in FIG. 6. As a result, the load on the hinge joint is shared across the two middle sections 26 of the two adjacent ladder segments 12; the fingers as the group are load bearing. Therefore, the ladder 10 is significantly strengthened in the direction of load that is perpendicular to the phone of the ladder.

In accordance with another feature of the invention, the ladder is configured for use with one or more bridge plates 80. This feature enables the ladder 10 to be deployed in a horizontal orientation, to enable the user to walk or crawl across it, for example, across a gap between one building and another.

In the illustrated embodiment, a plurality of bridge plates 80 are provided. The number of bridge plates 80 is dependent on the length of the ladder 10. Generally, enough bridge plates 80 are provided to cover all but one foot of the ladder 10 at each end. As one example, if the ladder 10 is twelve feet long, then six bridge plates 80 may be provided—four that are two feet long each, and two that are one foot long each. The bridge plates 80 are releasably connected with the ladder 10 as shown, to cover all but the outer one foot at each end of the ladder 10.

Each bridge plate 80 has an upside down U-shaped cross-sectional configuration including a main body portion 82 and two arms 84. The main body portion 82 may have openings or tread elements 86 to increase traction. The main body portion 82 also has openings 88 to enable the ladder knuckles to fit through.

Each arm section 84 has at least one locking opening 90. The ladder 10 has plate locking elements 92 that engage in the locking openings 90 of the bridge plates 80, to releasably secure the bridge plates to the ladder. The plate locking elements 92, in the illustrated embodiment, are configured as locking tabs located on the middle sections 26 of the side rails 30. The locking tabs 92 project laterally outward from the outer major side surface of the middle sections 26, in a direction away from the rungs 22, when the ladder 10 is deployed.

To install a bridge plate 80 on the ladder 10, the bridge plate is positioned over the ladder at the appropriate location along the length of the ladder. The bridge plate 80 is then pushed down onto the ladder 10. The two arms 84 of the bridge plate 80 are cammed outward by the locking tabs 92, then snap back inward when the locking openings 90 attain a position overlying the locking tabs.

The engagement of the locking tabs 92 in the locking openings 90 secures the bridge plate 80 on the ladder 10. The main body portion 82 of the bridge plate 80 extends parallel to and overlies the rungs 22 of the ladder 10. The engagement of the bridge plate arms 84 with the locking tabs 92 as the bridge plate 80 wraps around the ladder 10 provides a very secure connection of the bridge plate onto the ladder itself. The bridge plate 80, because it wraps around the ladder segment 12, significantly strengthens and stiffens the ladder 10 as a whole, rather than being simply an added-on element.

The bridge plates 80 are preferably position on the ladder 10 so as to have their center portions, not their ends, cover the "down" joints 50 in the ladder 10. This can help to prevent the ladder 10 from folding down (buckling) at those joints 50 when a load is applied.

To release a bridge plate 80 from the ladder 10, a tool such as a pry bar or screwdriver (not show) is inserted between one of the bridge plate arms 84 and the ladder 10. The tool is manipulated to bend the bridge plate arms 84 outward enough to enable them to be removed over the locking tabs 92 on the ladder 10. The bridge plates 80 can be stacked and nester for ease of carrying/storage, for example, in a separate pack of backpack.

A modified bridge plate (no shown) may have a lip that wraps under the bottom of the ladder side rail—that is, under the side opposite the main body portion of the bridge plate. This lip can further strengthen the engagement between the bridge plate and the ladder, increasing the load carrying capacity of the ladder when it is used in a horizontal orientation.

One additional improvement over the prior art ladders is that the ladder of the present invention is preferably is molded from flame retardant, anti-static, non-conducting polyamide resin. As a result, the ladder now can be safely used in an electrical environment. This safety advantage is another feature of the present invention.

The middle side rail sections on the first ladder segment are hingedly connected to the middle side rail sections on the second ladder segment by middle knuckles 65, 67 (FIGS. 4 and 5) at the hinge joint. The locking fingers 64, 66 are, as can be seen clearly in FIGS. 4 and 5, distinct elements from the middle knuckles 65, 67 and are located laterally between the middle knuckles 65, 67. The two outer locking fingers 64 are spaced apart from each other laterally to define a gap 69 between them. The third locking finger 66 is located on the middle side rail section at the gap 69 between the first and second locking fingers 64.

As can be seen in FIG. 6, when the ladder is in the straight condition the first and second and third locking fingers 64, 66 abut each other laterally and interlock to form a block that resists lateral load (from top to bottom as viewed in FIG. 6) on the ladder 10.

The invention claimed is:

1. A foldable ladder comprising:

a plurality of ladder segments hingedly connected to each other at a plurality of hinge joints, the ladder being configured to fold at the plurality of hinge joints between a folded stored condition and an extended straight condition, wherein the stored condition is configured to be used for storage or transportation, and the straight condition is configured to allow a user to ascend or descend the ladder during use;

the plurality of ladder segments including adjacent first and second ladder segments that are connected by a first hinge joint of the plurality of hinge joints;

each one of the first and second ladder segments including a respective rung element, the respective rung element having a rung extending laterally between and fixed to respective inner side rail sections;

the rung element of the first ladder segment being hingedly connected to the rung element of the second ladder segment by inner knuckles at the first hinge joint;

each one of the first and second ladder segments also including respective middle side rail sections and respective outer side rail sections, the respective middle side rail sections and the respective outer side rail sections being hingedly connected with the respective inner side rail sections and configured to fold relative to the respective inner side rail sections to form C-shaped side rails when the ladder is in the straight condition having a major length of each one of the C-shaped side rails extending perpendicular to a major length of each of the rungs;

the middle side rail sections on the first ladder segment being hingedly connected to the middle side rail sections on the second ladder segment by middle knuckles at the first hinge joint;

the outer side rail sections on the first ladder segment being hingedly connected to the outer side rail sections on the second ladder segment by outer knuckles at the first hinge joint;

the ladder further including locking features at the first hinge joint configured to limit unfolding of the first ladder segment with respect to the second ladder segment to about one hundred eighty degrees;

the locking features including projecting tabs on the inner knuckles of second ladder segment, and including projecting tabs on the outer knuckles of the second ladder segment, the projecting tabs configured to engage stop surfaces on the first ladder segment when the ladder is in the straight condition to limit the unfolding of the first ladder segment with respect to the second ladder segment to said about one hundred eighty degrees;

the locking features also including a plurality of locking fingers on the middle side rail sections, the plurality of locking fingers being distinguishable from the middle knuckles and having at least one set of locking fingers located laterally between at least one pair of the middle knuckles, the at least one set of locking fingers configured to: (a) engage additional stop surfaces when the ladder is in the straight condition to limit the unfolding of the first ladder segment with respect to the second ladder segment to said about one hundred eighty degrees, and (b) abut each other laterally to provide a lateral load bearing capability when in the straight condition;

the at least one set of locking fingers including first and second locking fingers on at least one of the middle side rail sections of the first ladder segment at the first hinge joint, the first and second locking fingers being spaced apart from each other laterally to define a gap; the at least one set of plurality of locking fingers also including a third locking finger located on one of the middle side rail sections of the second ladder segment at a location adjacent to the gap and between the first and second locking fingers;

the locking features including first and second stop surfaces of the additional stop surfaces on the second ladder segment at the first hinge joint, the first and second stop surfaces being located outward of and on opposite sides of the third locking finger;

the locking features also including a third stop surface of the additional stop surfaces on the first ladder segment at the first hinge joint, the third stop surface being located between the first and second locking fingers;

the first and second locking fingers on the first ladder segment being configured to project over and abuttingly engage the first and second stop surfaces on the second ladder segment, respectively, when the ladder is in the straight condition, to limit the unfolding of the first ladder segment with respect to the second ladder segment to said about one hundred eighty degrees;

the third locking finger on the second ladder segment being configured to project over and abuttingly engage the third stop surface on the first ladder segment when the ladder is in the straight condition to limit the unfolding of the first ladder segment with respect to the second ladder segment to said about one hundred eighty degrees; and wherein, when the ladder is in the straight condition, the first, second and third locking fingers interlock and abut each other laterally to form a block configured to resist lateral loading on the ladder.

* * * * *